US006244552B1

(12) United States Patent
Adams et al.

(10) Patent No.: US 6,244,552 B1
(45) Date of Patent: Jun. 12, 2001

(54) MOUNTING BRACKET FOR MAINTAINING AN ARTICLE LEVEL

(75) Inventors: Bryon R. Adams, North Vancouver; George F. Radke, Delta, both of (CA)

(73) Assignee: Force 10 Marine Ltd., North Vancounver (CA)

( * ) Notice: Subject to any disclaimer, the term of this patent is extended or adjusted under 35 U.S.C. 154(b) by 0 days.

(21) Appl. No.: 09/296,444

(22) Filed: Apr. 21, 1999

(51) Int. Cl.[7] ..... E04G 3/00

(52) U.S. Cl. ..... 248/274.1; 248/222.51; 248/222.52; 248/202.1

(58) Field of Search ..... 248/274.1, 222.51, 248/22.52, 276.1, 287.1, 299.1, 201, 202.1; 312/24, 27, 28, 29; 126/24, 30, 50

(56) References Cited

U.S. PATENT DOCUMENTS

| | | | | |
|---|---|---|---|---|
| 355,498 | | 1/1887 | Bekofsky . | |
| 2,143,218 | * | 1/1939 | Thurner | 312/24 |
| 2,229,558 | * | 1/1941 | Fox | 312/24 |
| 2,411,088 | * | 11/1946 | Fox | 312/24 |
| 2,475,499 | | 7/1949 | Hearst . | |
| 2,478,531 | * | 8/1949 | Harris et al. | 312/28 |
| 2,693,176 | | 11/1954 | Spiers et al. . | |
| 2,790,887 | * | 4/1957 | Gelfand | 219/452.13 |
| 2,903,314 | * | 9/1959 | Van Ordt | 312/29 |
| 2,987,363 | * | 6/1961 | Morse | 312/274 |
| 4,199,121 | * | 4/1980 | Le Febvre | 248/48.2 |
| 4,290,657 | * | 9/1981 | Haas | 312/21 |
| 4,579,397 | * | 4/1986 | Gall et al. | 312/27 |
| 4,653,462 | | 3/1987 | DeFoe . | |
| 4,843,978 | * | 7/1989 | Schmidt et al. | 108/138 |

* cited by examiner

*Primary Examiner*—Anita M. King
*Assistant Examiner*—N. Morrison
(74) *Attorney, Agent, or Firm*—Kolisch Hartwell Dickinson McCormack & Heuser

(57) ABSTRACT

Apparatus for mounting a first article, such as an appliance, to a second article, such as a moving vehicle, to permit relative movement of the first article with respect to the second article in order maintain the level of the first article. The apparatus comprises a bracket for fixed attachment to the moving vehicle. There is a handle pivotally connected to the bracket, and a lever pivotally mounted to the handle to pivotally support the appliance and to adjust the position of the appliance with respect to the bracket in response to pivotal movement of the handle. This arrangement permits the appliance to be moved between a lowered position and a raised position while maintaining its level at all times so that the appliance can be stowed to conserve space when not in use.

20 Claims, 4 Drawing Sheets

MOUNTING BRACKET FOR MAINTAINING AN ARTICLE LEVEL

FIELD OF THE INVENTION

This invention relates to a mounting bracket for installing an article in an environment subject to rocking movement in order to maintain the article in a substantially level position. The present invention is particularly suited for mounting a marine stove in the galley of a vessel so that the stove can be stowed away when not in use.

BACKGROUND OF THE INVENTION

Gimbals arrangements for maintaining the level of an article in a moving vehicle are well known. In boats and aircraft, gimbals are important for keeping instruments such as a compass or chronometer level. They are particularly popular in pleasure boats for maintaining the level of tables or appliances such as stoves to prevent spills due to the normal rocking motion of the boat. Examples of prior gimballed structures, particularly marine stoves, are provided in the following patents:

U.S. Pat. No. 355,498 to Bekofsky

U.S. Pat. No. 2,475,499 to Hearst

U.S. Pat. No. 2,693,176 to Spiers et al.

U.S. Pat. No. 4,653,462 to DeFoe

In pleasure boats, space is at a premium and it is generally desirable for articles that are not in use to be stowed so that they are out of the way. Gimballed appliances, particularly stoves, have not previously been efficiently stowable.

SUMMARY OF THE INVENTION

To address this problem, applicant has developed a bracket arrangement adapted to support an article such as a stove or other appliance so that it can be quickly and efficiently moved between a lowered or stowed position and a raised or operating position while being maintained at a generally level orientation at all times.

Accordingly, the present invention provides apparatus for mounting a first article to a second article to permit relative movement of the first article with respect to the second article comprising:

a bracket for fixed attachment to the second article;

a handle pivotally connected to the bracket;

a lever pivotally mounted to the handle to pivotally support the first article and to adjust the position of the first article with respect to the bracket in response to pivotal movement of the handle so that the first article is movable between a lowered position and a raised position.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
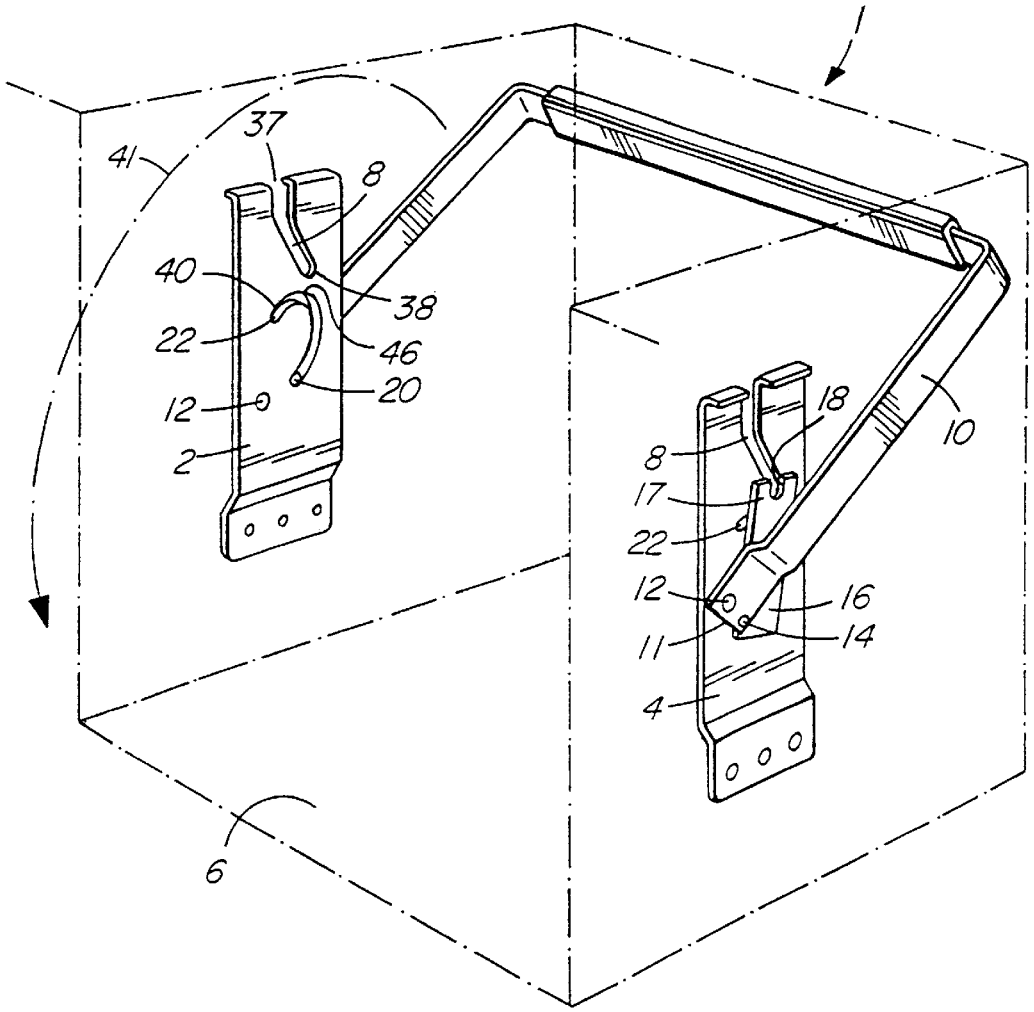
FIG. 1 is a perspective view of a preferred embodiment of the mounting bracket of the present invention with the bracket configured such that the supported article is in the lowered position.
Figure 2:
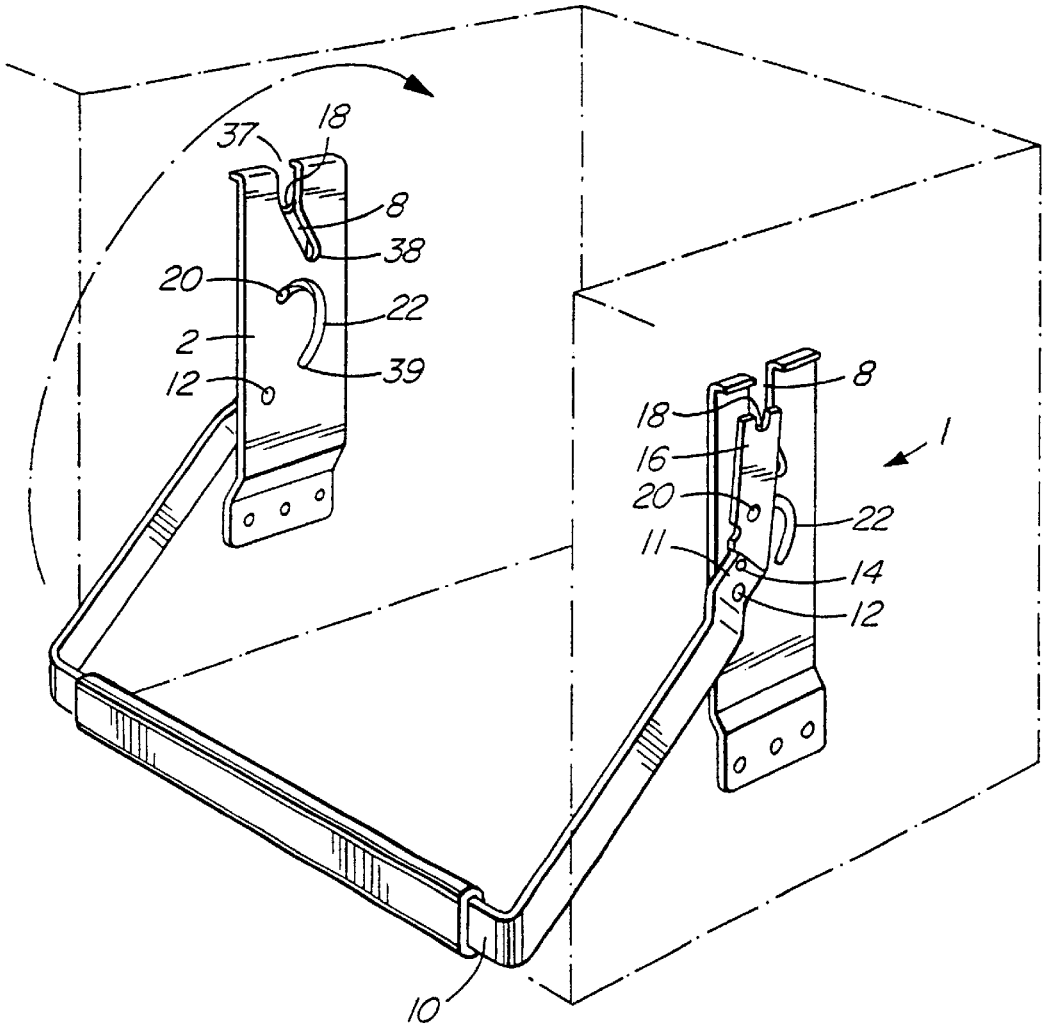
FIG. 2 is a perspective view of the mounting bracket configured such that the supported article is in the raised position.

Referring to FIGS. 1 and 2, there is shown a preferred embodiment of a mounting bracket system 1 according to the present invention installed in a cavity 6 (shown by dashed lines) formed in moving vehicle such as a boat or the like. Cavity 6 is dimensioned to receive a first article such as a marine stove or other appliance (not shown) that is required or desired to remain generally level despite movement of the vehicle.

In the illustrated embodiment, the structure comprises two spaced brackets 2 and 4 that are rigidly mounted to opposed walls of open region 6. A generally C-shaped handle 10 extends between the brackets and is pivotally connected at its ends 11 to each bracket at pivot point 12. Each end 11 of handle 10 is also pivotally connected at pivot joint 14 to a lever 16 adapted to pivotally support the appliance. As will be explained in detail below, handle 10, and lever 16 co-operate to permit adjustment of the position of the supported appliance with respect to the brackets and the open cavity 6. In response to pivotal movement of the handle, the mounting bracket system can be adjusted between a position shown in FIG. 1 in which the supported appliance is lowered and stowed within the cavity and a position shown in FIG. 2 in which the supported appliance is raised to a useful operating position.

Figure 5:
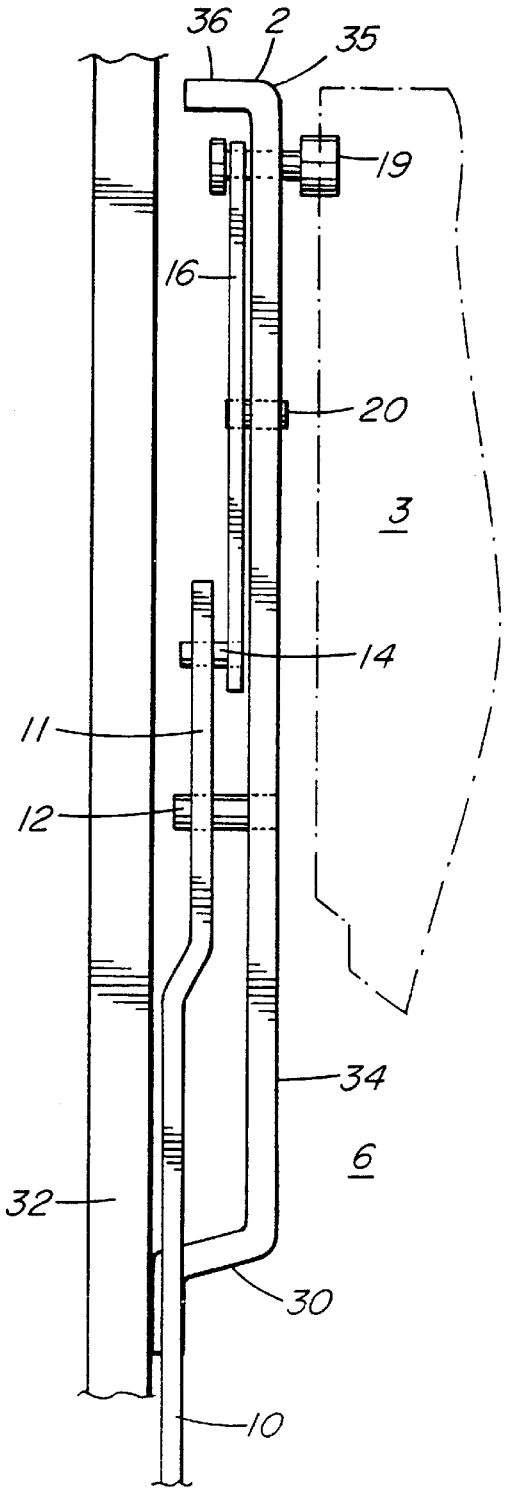
FIG. 5 is a end view of the bracket showing the arrangement of the component parts when the supported article is in the raised position.
Figure 4:
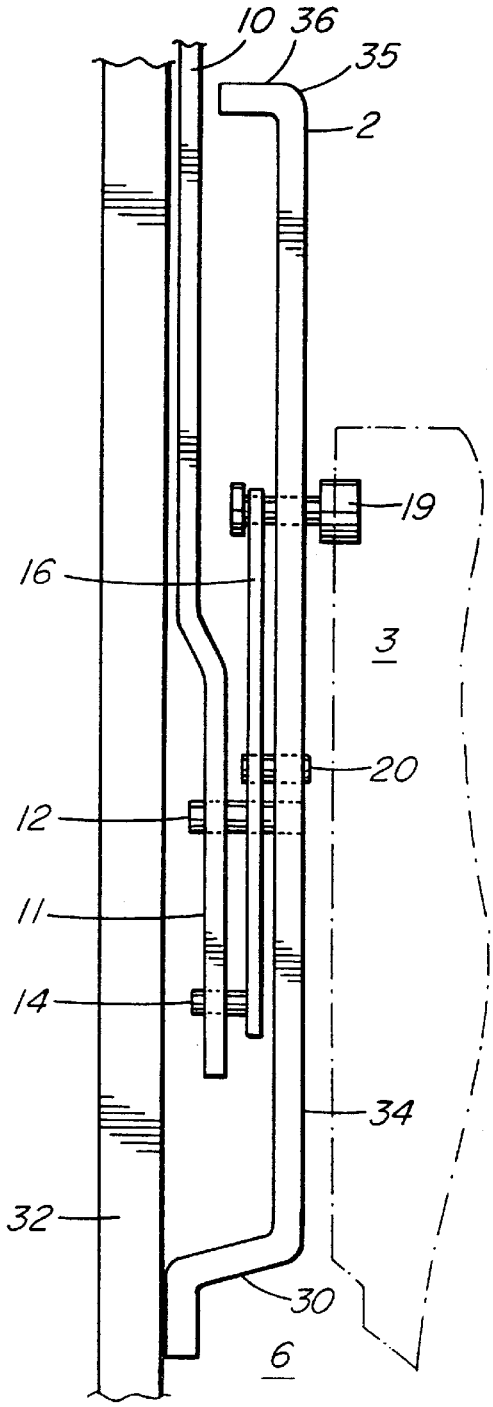
FIG. 4 is a end view of the bracket showing the arrangement of the component parts when the supported article is in the lowered position.

FIGS. 4 and 5 are detail end views of bracket 2 viewing along the adjacent side wall of cavity 6. Bracket 4 on the opposite side of cavity 6 is identical. FIG. 4 shows the handle and the overall bracket structure in the same position as in FIG. 1, while FIG. 5 corresponds to FIG. 2.

As best shown in FIGS. 4 and 5, bracket 2 is generally J shaped with a flanged base 30 that is rigidly mounted by fasteners extending through downwardly extending flange 31 into the side wall 32 of cavity 6. The generally vertical main body 34 of bracket 2 is spaced apart from side wall 32 by base 30 to provide clearance for pivoting movement of handle 10 and lever 16 between the bracket and the side wall. An upper flange 36 extends inwardly toward side wall 32 at the top edge 35, but a gap is left to permit movement of handle 10 from one side of the bracket to the other about pivot point 12.

There is a first slot 8 formed in the top edge 35 of the brackets as best shown is FIGS. 1 and 2. FIGS. 4 and 5 show the appliance to be supported 3 is formed with protruding pivots 19 that are slidably received in slots 8 in brackets 2 and 4. Slots 8 define a path of movement for the support article between the lowered and raised positions. Preferably, slots 8 include an angle as illustrated so that the supported appliance is raised and moved forwardly and lowered and moved rearwardly on movement of handle 10. Each slot has an open end 37 and a closed end 38.

While slots 8 guide the movement of the appliance, lever 16 actually applies the force necessary to move the pivots 19 along the slots of a bracket. Lever 16 includes a support end 17 formed with a recess 18 to pivotally engage and support the inner end of protruding pivot 19 as it extends through slot 8 of the bracket into the clearance space between the bracket and side wall 32. The opposite end of lever 16 is formed with a pin the is pivotally connected at joint 14 to the end 11 of handle 10.

As best shown in FIGS. 1 and 2, each bracket is formed with a second slot 22 in the main body of the bracket below first slot 8. Second slot 22 is shaped generally like an inverted "J" having a lower end 39 and upper end 40. Lever 16 is formed with a protruding pin 20 intermediate joint 14 and recess 18. Pin 20 engages in slot 22 such that movement of pin 20 in slot 22 controls the motion of lever 16. Slot 22 is shaped so as to maintain lever recess 18 in alignment with and adjacent to slot 8 during movement of handle 10.

Figure 3:
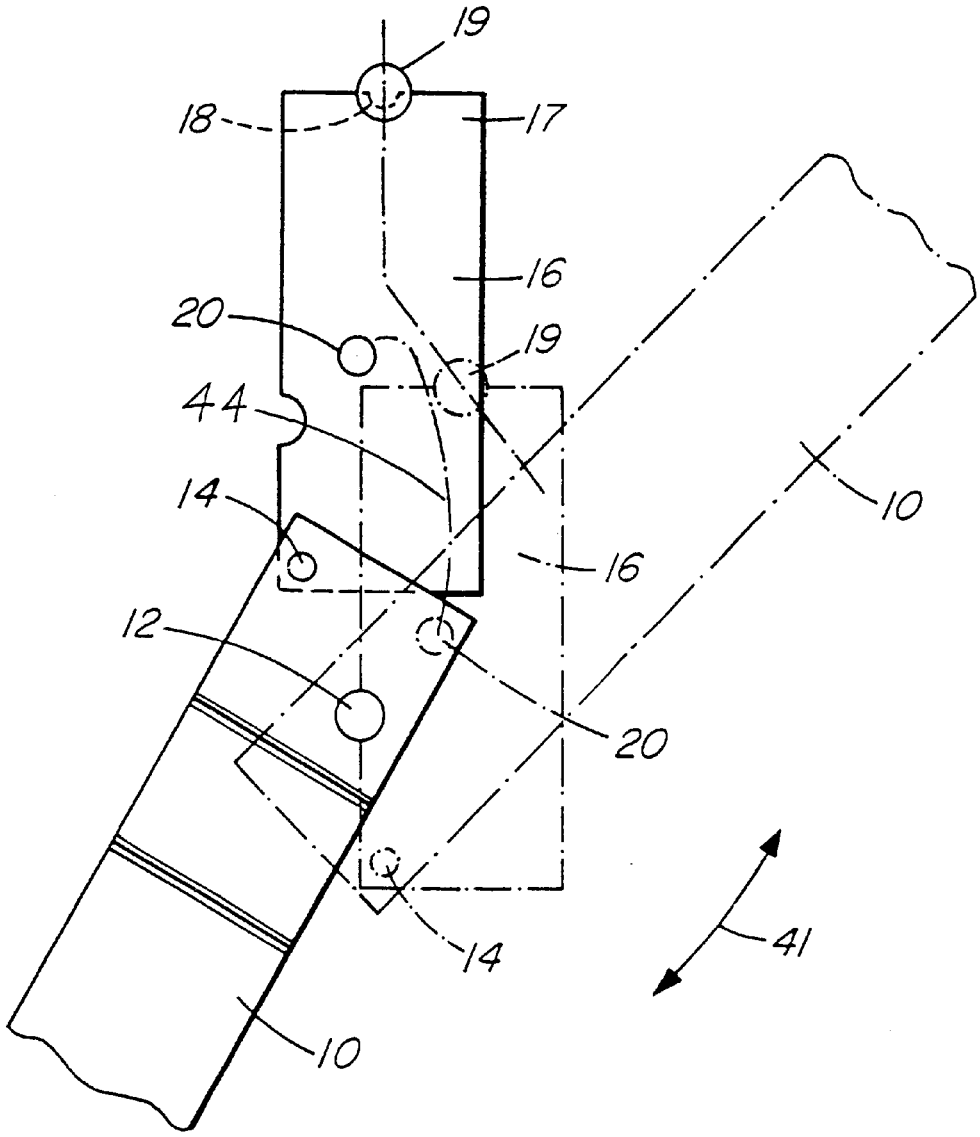
FIG. 3 is a detail schematic view of the handle and lever of the bracket showing the manner in which they move relative to one another and co-operate to raise and lower the supported article.

FIG. 3 is a schematic view showing the manner in which handle 10 and lever 16 move relative to one another and co-operate to raise and lower the supported article. The position of the end 11 of handle 10 and lever 16 when in the configuration shown in FIG. 1 is shown by dashed lines in FIG. 3. In this position, handle 10 is raised and to the rear and the supported appliance is lowered rearwardly out of the way within cavity 6. Handle 10 is readily accessible to move the appliance to its useful position. Similarly, the position of the end 11 of handle 10 and lever 16 when in the configuration shown in FIG. 2 is shown by solid lines in FIG. 3 with the handle rotated forwardly and downwardly and the supported appliance raised upwardly and forwardly for ready access. In this position, handle 10 is out of the way below the supported appliance.

Arrow 41 in FIGS. 1, 2 and 3 indicates the pivoting movement of handle 10 about pivot 12 as the handle is moved between its raised, rearward position and its lowered, front position. Line 42 shows the path traced by pivot pin 19 supporting appliance 3 in bracket slot 8 as the handle is pivoted. Recess 18 in lever 16 acts to lift pin 19 along the length of slot 8. Pivot pin 19 resting on the closed end 38 of slot 8 defines a secured and stable lowered position for the supported appliance.

Arcuate line 44 in FIG. 3 shows the path traced by lever pin 20 in bracket slot 22 as the handle is pivoted. Lever pin 20 engaging in upper end 40 of slot 22 defines a secure and stable raised position of the first article. In fact, slot 22 preferably traces a path that includes a raised segment 46 between lower end 39 and upper end 40 that is higher than the upper end. This results in lever recess 18 and the supported appliance being moved past a position higher than the raised position of the appliance as the first article is moved to the raised position with the result that the appliance is securely and reliably held in place in the raised position as gravitational forces acting upon the appliance must be overcome to move the first article from the raised position to the lowered position.

Although the present invention has been described in some detail by way of example for purposes of clarity and understanding, it will be apparent that certain changes and modifications may be practised within the scope of the appended claims.

What is claimed is:

1. Apparatus for mounting a first article to a second article to permit relative movement of the first article with respect to the second article, the apparatus comprising:

a bracket for fixed attachment to the second article, the bracket including a first slot adapted to receive slidably a protruding pivot originating from the first article, the first slot defining a path of movement for the first article between a lowered position and raised position;

a handle pivotally connected to the bracket;

a lever pivotally mounted to the handle pivotally to support the first article and to adjust the position of the first article with respect to the bracket in response to pivotal movement of the handle so that the first article is movable between the lowered position and the raised position.

2. Apparatus as claimed in claim 1 in which the lever includes a support end formed with a recess for pivotally engaging and supporting the protruding pivot extending through the first slot of the bracket, and a pivot end pivotally connected to the handle.

3. Apparatus as claimed in claim 2 in which the lever includes a protruding lever pin and the bracket includes a second slot adapted to slidably receive the lever pin with movement of the lever pin in the second slot controlling the motion of the lever.

4. A Apparatus as claimed in claim 3 in which the second slot is configured to maintain the lever recess in alignment with and adjacent the first slot during movement of the handle.

5. Apparatus as claimed in claim 3 in which the lever pin is intermediate the pivot end and the support end of the lever.

6. Apparatus as claimed in claim 3 in which the second slot has a lower end and an upper end and the lever pin engaging with the upper end of the second slot defines the raised position of the first article.

7. Apparatus as claimed in claim 6 in which the second slot follows a path that includes a raised segment between the lower end and the upper end that is higher than the upper end such that the lever recess and the supported first article are moved past a position higher than the raised position as the first article is moved to the raised position such that gravitational forces acting upon the first article must be overcome to move the first article from the raised position to the lowered position.

8. Apparatus as claimed in claim 1 in which the first slot has an open end and a closed end for accommodating and supporting the protruding pivot of the first article when the first article is in the lowered position.

9. Apparatus as claimed in claim 1 formed from a pair of spaced brackets with the handle extending between and being pivotally connected to each bracket, the brackets acting to suspend and support the first article.

10. Apparatus as claimed in claim 1 in which the handle is pivotally attached to the bracket and the lever such that the handle is pivoted to a lowered position when the first article is in the raised position and to a raised position when the first article is in the lowered position.

11. Apparatus for mounting a stove to an interior of a boat to permit relative movement of the stove with respect to the boat, the apparatus comprising:

a bracket for fixed attachment to the interior of the boat, the bracket including a first slot adapted to slidably receive a protruding pivot originating from the stove, the first slot defining a path of movement for the stove between a lowered position and a raised position;

a handle pivotally connected to the bracket;

a lever pivotally mounted to the handle pivotally to support the stove and to adjust the position of the stove with respect to the bracket in response to pivotal movement of the handle so that the stove is movable between the lowered position and the raised position.

12. Apparatus as claimed in claim 11, in which the lever includes a support end formed with a recess for pivotally engaging and supporting the protruding pivot extending through the first slot of the bracket, and a pivot end pivotally connected to the handle.

13. Apparatus as claimed in claim 12, in which the lever includes a protruding lever pin and the bracket includes a second slot adapted to slidably receive the lever pin with movement of the lever pin in the second slot controlling the motion of the lever.

14. Apparatus as claimed in claim 13, in which the second slot is configured to maintain the lever recess in alignment with and adjacent the first slot during movement of the handle.

15. Apparatus as claimed in claim 13, in which the lever pin is intermediate the pivot end and the support end of the lever.

16. Apparatus as claimed in claim 13, in which the second slot has a lower end and an upper end and the lever pin engaging with the upper end of the second slot defines the raised position of the stove.

17. Apparatus as claimed in claim 16, in which the second slot follows a path that includes a raised segment between the lower end and the upper end that is higher than the upper end such that the lever recess and the supported stove are moved past a position higher than the raised position as the stove is moved to the raised position such that gravitational forces acting upon the stove must be overcome to move the stove from the raised position to the lowered position.

18. Apparatus as claimed in claim 11, in which the first slot has an open end and a closed end for accommodating and supporting the protruding pivot of the stove when the stove is in the lowered position.

19. Apparatus as claimed in claim 11 formed from a pair of spaced brackets with the handle extending between and being pivotally connected to each bracket, the brackets acting to suspend and support the stove.

20. Apparatus as claimed in claim 11, in which the handle is attached pivotally to the bracket and the lever such that the handle is pivoted to a lowered position when the stove is in the raised position and to a raised position when the stove is in the lowered position.

* * * * *